US006384797B1

(12) United States Patent
Schaffner et al.

(10) Patent No.: US 6,384,797 B1
(45) Date of Patent: May 7, 2002

(54) RECONFIGURABLE ANTENNA FOR MULTIPLE BAND, BEAM-SWITCHING OPERATION

(75) Inventors: James H. Schaffner, Chatsworth; Daniel Sievenpiper, Los Angeles; Jonathan J. Lynch, Oxnard; Robert Y. Loo, Agoura Hills, all of CA (US); Pyong K. Park, Tucson, AZ (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/629,681

(22) Filed: Aug. 1, 2000

(51) Int. Cl.[7] ..... H01Q 3/40
(52) U.S. Cl. ..... 343/795; 343/833; 343/754
(58) Field of Search ..... 343/795, 754, 343/755, 833, 834, 909, 700 MS, 750

(56) References Cited

U.S. PATENT DOCUMENTS

| | | | | |
|---|---|---|---|---|
| 4,827,266 A | * | 5/1989 | Sato et al. | 343/700 MS |
| 4,905,014 A | | 2/1990 | Gonzalez et al. | 343/909 |
| 5,126,716 A | * | 6/1992 | Munger | 338/306 |
| 5,541,614 A | * | 7/1996 | Lam et al. | 343/792.5 |

FOREIGN PATENT DOCUMENTS

| | | |
|---|---|---|
| WO | 99/50929 | 10/1999 |

OTHER PUBLICATIONS

U.S. application No. 09/537,923, Sievenpiper et al., filed Mar. 29, 2000.
U.S. application No. 09/537,922, Sievenpiper et al., filed Mar. 29, 2000.
U.S. application No. 09/537,921, Sievenpiper et al., filed Mar. 29, 2000.

* cited by examiner

*Primary Examiner*—Don Wong
*Assistant Examiner*—James Clinger
(74) *Attorney, Agent, or Firm*—Ladas & Parry

(57) ABSTRACT

A multiple band reconfigurable reflecting antenna array and method for multiple band operation and beam steering. An array of dipole antennas is disposed on a multiple band high impedance surface. The antenna array is reconfigured by changing the length of the dipole elements, to thereby change the dipoles resonant frequency. At a given frequency band, small changes in dipole length allow to steer the reflected beam in the selected direction; whether large changes in dipole length permit to switch the operating frequency band. A method of broadening the bandwidth of a high impedance surface is also exposed.

43 Claims, 5 Drawing Sheets

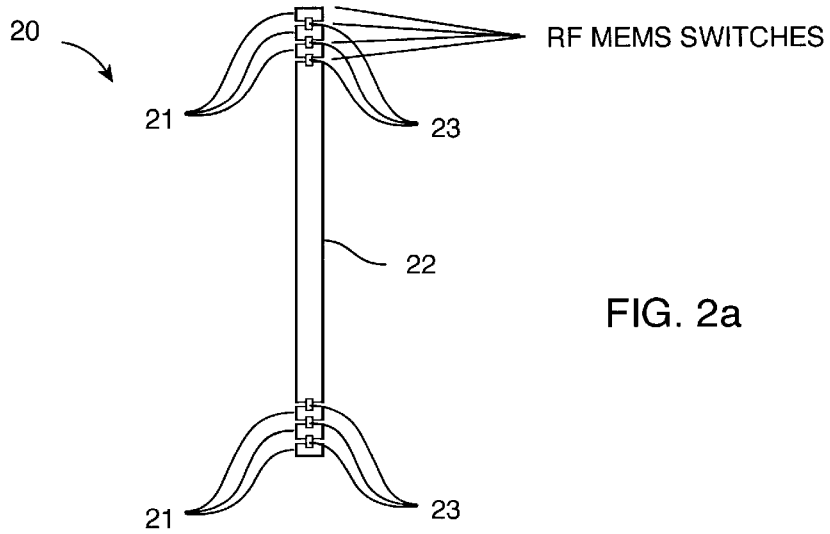
FIG. 2a
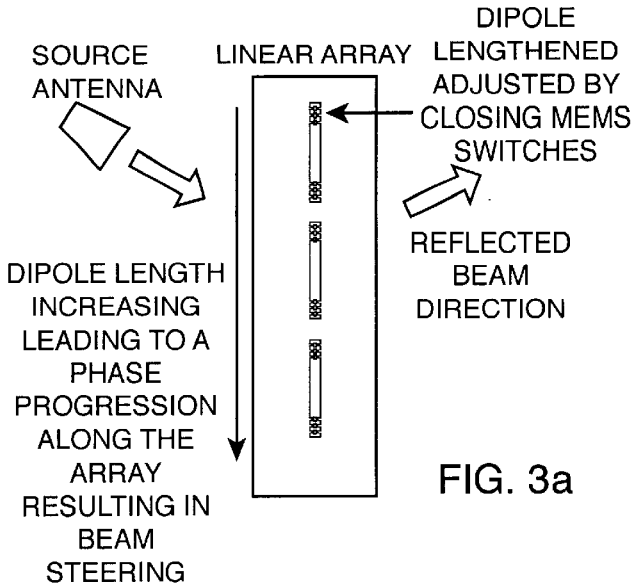
FIG. 3a
FIG. 3b
2-D BEAM STEERING
BEAM STEERING ARRAY
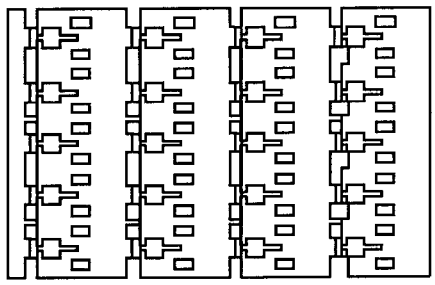
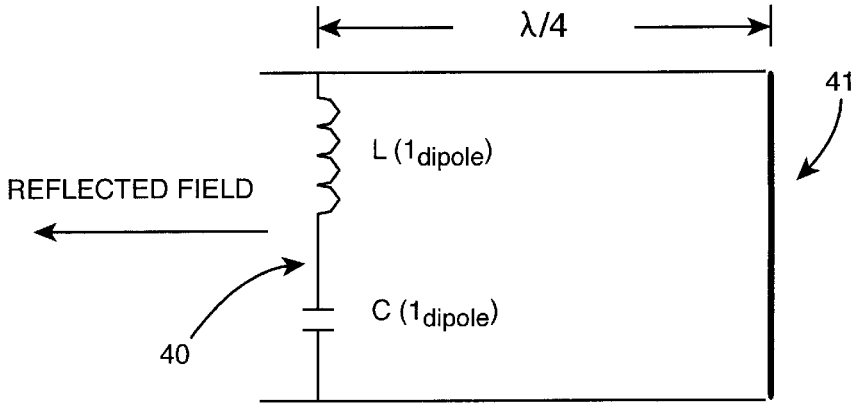
FIG. 4

FIG. 5a
PRIOR ART
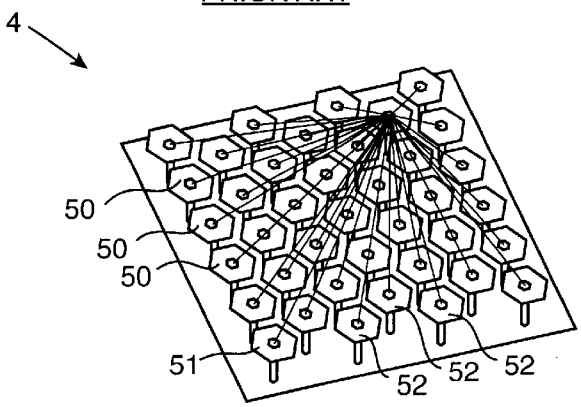
FIG. 5b
PRIOR ART
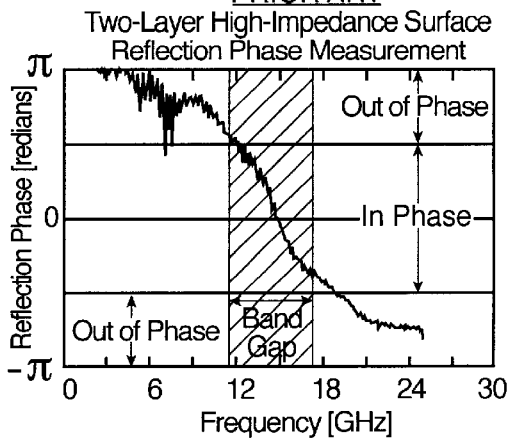
FIG. 5c
PRIOR ART
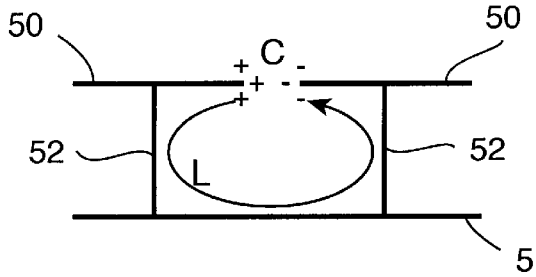
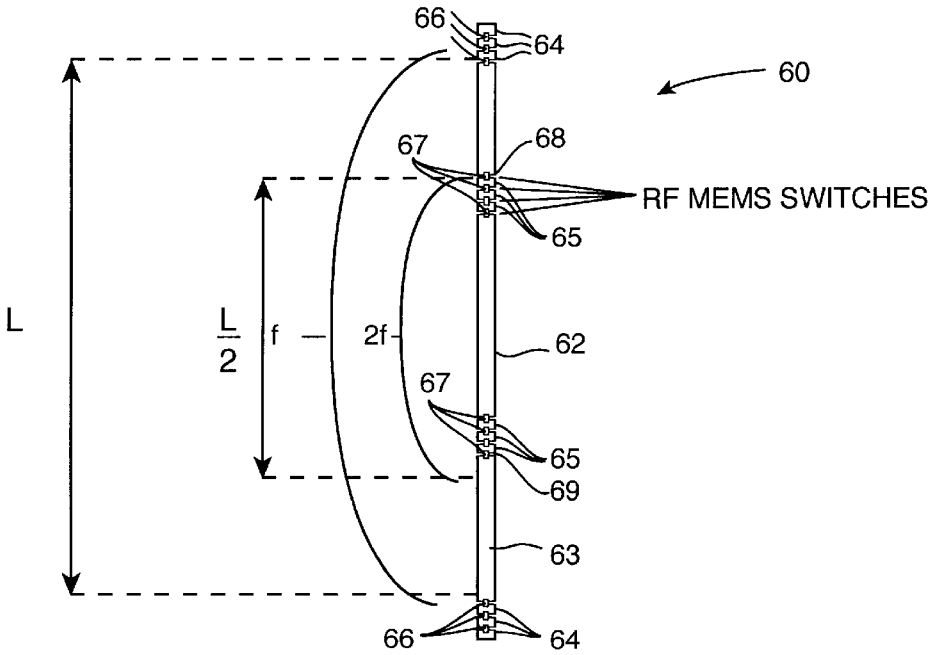
FIG. 6

RECONFIGURABLE ANTENNA FOR MULTIPLE BAND, BEAM-SWITCHING OPERATION

TECHNICAL FIELD

This invention relates to a reconfigurable antenna array system, and includes an array of dipole antenna elements disposed on a multiple band high impedance surface. The antenna array is configured by changing the resonant frequency of the individual dipoles that constitute the array. At a given frequency band, small changes in the dipoles resonant frequencies allow for the antenna array to be configured so that the reflected radiation forms a beam in the far-field, and can be pointed to selected directions. Larger changes in the dipoles resonant frequencies allow for shifting from one operating frequency band to a different band. This invention has particular applications in satellite radar and airborne communication node (ACN) systems where a wide bandwidth is important and the aperture must be continually reconfigured for various functions. Additionally, this invention has applications in the field of terrestrial high frequency wireless systems.

BACKGROUND OF THE INVENTION

The prior art includes U.S. Pat. No. 4,905,014 to Daniel G. Gonzalez, Gerald E. Pollen, and Joel F. Walker, "Microwave passing structure for electromagnetically emulating reflective surfaces and focusing elements of selected geometry". This patent describes placing antenna elements above a planar metallic reflector for phasing a reflected wave into a desired beam shape and location. It is a flat array that emulates differently shaped reflective surfaces (such as a dish antenna). However it does not disclose a system that is reconfigurable and can operate at multiple frequency bands.

The prior art includes U.S. Pat. No. 5,541,614 to Juan F. Lam, Gregory L. Tangonan, and Richard L. Abrams, "Smart antenna system using microelectromechanically tunable dipole antennas and photonic bandgap materials". This patent shows how to use RF MEMS (Micro Electro-Mechanical Switches) and bandgap photonic surfaces for reconfigurable dipoles. Although this invention lists a number of reconfigurable dipole antenna architectures, it does not disclose the dipole reflector antenna, and it does not show how to use multiple band, high impedance surfaces (a sub-class of photonic bandgap material). Furthermore, in the present invention the dipole array is fed from free space rather than a transmission line.

The present invention also relates to U.S. patent application Ser. No. 09/537,923 entitled "A tunable impedance surface" filed on Mar. 29, 2000 and to U.S. patent application Ser. No. 09/537,922 entitled "An electronically tunable reflector" filed on Mar. 29, 2000, and to U.S. patent application Ser. No. 09/537,921 entitled "An end-fire antenna or array on surface with tunable impedance" filed on Mar. 29, 2000, the disclosures of which are hereby incorporated herein by this reference. The present invention improves upon the high impedance surface of U.S. patent application Ser. No. 09/537,923 entitled "A tunable impedance surface", and provides a method of broadening the surface operating bandwidth.

As an aid in understanding the principle of operation of this invention, the prior art is instructive. Turning to FIG. 1*a*, a dipole element 1, located $\lambda/4$ away from a metallic ground plane 2, is shown. An incident plane wave 3 is reflected from the ground plane 2 and also scattered from the dipole element 1. When the dipole element is at its resonant length, (i.e., its length $1_d$ is appoximately equal to half of the effective signal wavelength, $1_d \approx \frac{1}{2}\lambda_{eff}$), scattering from the dipole is very strong and the effect from the ground plane is negligible. Thus, the total field has a reflection phase of approximately 180° (at the plane of the dipole). If the dipole is far from its resonant length, then scattering from the dipole is weak and the reflection phase, due primarily to the ground plane, is approximately 0° (at the plane of the dipole). Therefore, the phase of the reflected field from the dipole element can be adjusted by making small changes in the length of the dipole.

As an example, simulation that shows the behavior of the reflected phase versus dipole length is represented in FIG. 2. The simulation assumes that the dipole element is part of an infinite array, and is located in free space, $\lambda/4$ away from the ground plane. It further assumes a operating frequency of 11.8 GHz and that the dipole strip is 0.1 inch (CGS) in width. The dipole length varies from 0.1 to 0.8 inch. As can be seen in FIG. 2, the reflection phase of the dipole element can be tuned over a wide range, about 85°, for a length change of only 0.05 inch FIG. 2*a* demonstrates a technique of varying the length of a dipole element using RF MEMS technology. The dipole element 20 is segmented into a main segment 22 and a plurality of smaller segments 21. Each segment is interconnected to the adjacent one by an RF MEMS switch 23. By opening or closing the RF MEMS switches 23, the dipole length can be changed in steps equal to small segment length plus switch length. In this example, the small segments are approximately 200 $\mu$m in length, and the switches are about 100 $\mu$m long. Consequently, when a switch is opened, the dipole length is increased by 300 $\mu$m. This corresponds to approximately a 10° change in the reflected phase. By making the segments and/or switches smaller, a finer phase tunability can be achieved.

These length-changeable dipole elements can be incorporated into an array, disposed above a ground plane, and tuned to create a reflection phase gradient across the array. In this configuration, the total reflected wave forms a beam, which can be steered to incremental angular directions, by creating uniform phase gratings across the array. FIGS. 3*a* and 3*b* illustrate this concept for a linear array and a planar array respectively. This type of array can then serve as a stand-alone antenna or as a subreflector to another primary reflecting surface, such as a Cassegrain antenna.

However, the approach described in the immediately preceding paragraph has bandwidth limitations, as this will now be explained. Each dipole element of the array is modeled as a series resonance circuit 40, located $\lambda/4$ from a short circuit 41, as illustrated by FIG. 4. An infinite array approximation is assumed. The values of the inductance and capacitance are functions of the dipole length, width, and unit cell size. When the short circuit is located $\lambda/4$ from this susceptance (LC circuit), it appears as an open circuit across the susceptance and the reflection coefficient of the element can be tuned such that the reflection phase takes values over a full range of angles as shown in FIG. 2. However, at a frequency where the distance between the dipole and the ground plane is $\lambda/2$, the ground plane effectively shorts out the dipole and the reflected phase is locked at 180°, regardless of dipole length (no tuning is possible). Thus, as the array operates over a range of frequencies, inducing the distance between the ground plane and the dipole to vary between $\lambda/4$ and $\lambda/2$, the tuning range of the reflected phase becomes more and more limited. The present invention overcomes this limitation by placing the dipole array over a high impedance surface.

A high impedance surface is a filter structure which has the capability of reflecting an incident plane wave with a 0° phase shift. The basic structure of a high impedance surface is shown in FIG. 5*a,* and can be fabricated using multi-layer printed circuit board technology. Preferably hexagonal or square metal patches 50 are disposed on the top surface and connected to a lower metal sheet 51, by plated metal posts 52. The high impedance surface 54 acts as a filter to prevent the propagation of electric currents along the surface, over the frequency stopband. Therefore, unlike conventional conductors, propagating surface waves are not supported within the frequency stopband. Furthermore, incident plane waves are reflected without the phase reversal that occurs on an ordinary metal surface. FIG. 5*b* shows the reflection phase of the high impedance surface 54. The bandwidth over which the reflected phase lies between −90° and 90°, is given by:

$$\text{Equation 1:} \qquad \frac{\Delta f}{f_o} = \frac{\sqrt{\frac{L}{C}}}{\sqrt{\frac{\mu}{\varepsilon}}}$$

where L and C are related to the equivalent circuit model (see FIG. 5*c*) of the high impedance surface (and not to be confused with the dipole model of FIG. 4). As shown in FIG. 5*c,* the capacitance C is due to the proximity of the top metal patches 50, and the inductance L originates from the current loops within the structure. $f_0$ is the frequency for which the reflected wave has a 0° phase shift, $\mu$ and $\epsilon$ are the material permeability and permettivity respectively.

In accordance with this invention, an array of reconfigurable dipole antennas is disposed above a high impedance surface. In this manner, the dipole elements do not have to be placed $\lambda/4$ away from the ground plane as required by the prior art. This has the effect of making the system geometry independent of the frequency of operation. Thus, the operating frequency can be changed without having to alter the relative geometry of the array and the back plane, for the purpose of maintaining a $\lambda/4$ distance between them. This allows the array to maintain tunability over the full bandwidth of the high impedance surface.

The present invention provides an apparatus and method for tuning the array by changing the length of the dipole elements using RF MEMS technology, which overcomes the problems posed in the prior art, by the use of photoconductive switches.

BRIEF DESCRIPTION OF THE INVENTION

This invention provides a multiple band, reconfigurable electromagnetic reflecting antenna system which can be reconfigured to operate at multiple frequency bands; the user can select the operating frequency band from a range that can be anywhere within the total surface bandwidth. Furthermore, at a given operating frequency band, the antenna system is capable of forming an antenna beam in the far-field and pointing the beam to selected directions.

In accordance with this invention, an array of dipole antenna elements is fabricated on top of a multiple band, high impedance surface. Reconfigurability is achieved by varying the resonant frequency of each dipole which is a function of dipole length. Thus by changing the dipole length, one can vary the resonant frequency of the dipole. Each dipole antenna element is segmented, and the segments are interconnected with RF MEMS (Micro Electro-Mechanical Switches) which can be opened or closed to change the length of the dipole. Small changes in dipole length allow for beam steering and forming a beam in the far-field, while larger changes allow for changes in the antenna array operating frequency band.

This invention further provides a method of increasing the bandwidth of the high impedance surface that supports the array of dipoles, by increasing the surface inductance.

BRIEF DESCRIPTION OF THE DRAWINGS

FIG. 2*a* depicts a dipole element whose length can be changed by actuating the RF MEMS switches which connect the different segments that constitute the dipole.

FIGS. 3*a* and 3*b* illustrate beam steerability in the case of a linear and planar dipole array, respectively.

FIG. 4 is a series resonance circuit equivalent of a dipole element of the array shown in FIG. 3.

FIG. 5*a* depicts a perspective view of a high impedance surface.

FIG. 5*b* shows the measured reflection phase as a function of frequency for the high impedance surface of FIG. 5*a*.

FIG. 5*c* is a circuit equivalent model of two elements of the high impedance surface of FIG. 5*a*.

FIG. 6 depicts a dipole element whose length can be changed by small increments and/or large increments by actuation of the RF MEMS switches that connect the dipole segments.

DETAILED DESCRIPTION OF THE INVENTION

Figure 1:
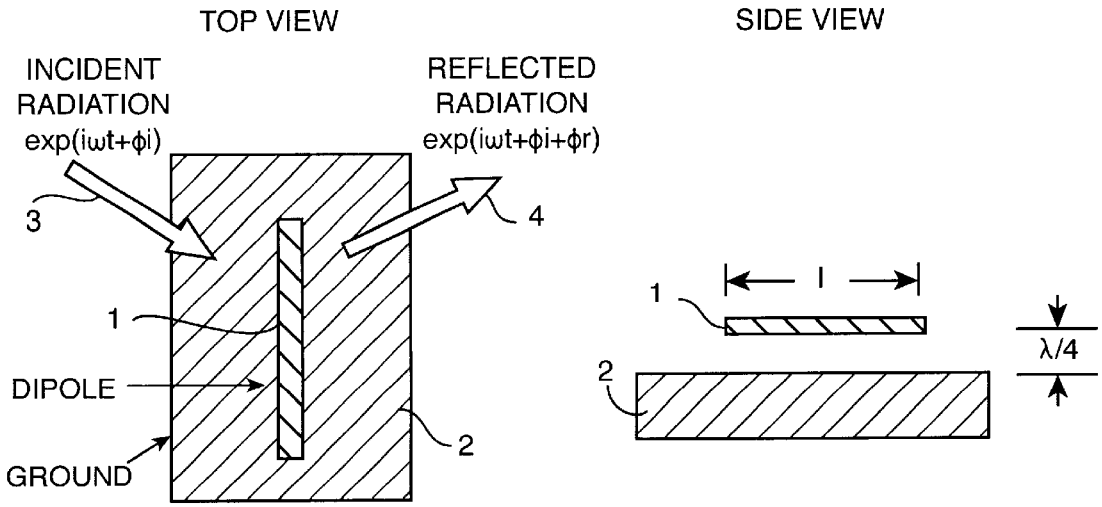
FIG. 1 PRIOR ART
FIG. 1 illustrates the principle of operation of the proposed array. An element of the dipole array placed $\lambda/4$ away from a ground plane is shown.
Figure 2:
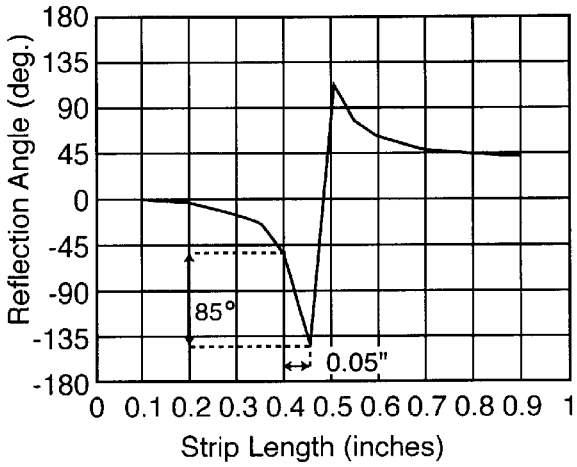
FIG. 2 shows a simulated model of the reflection phase as a function of dipole length for an infinite array similar to the array of FIG. 1
Figure 7:
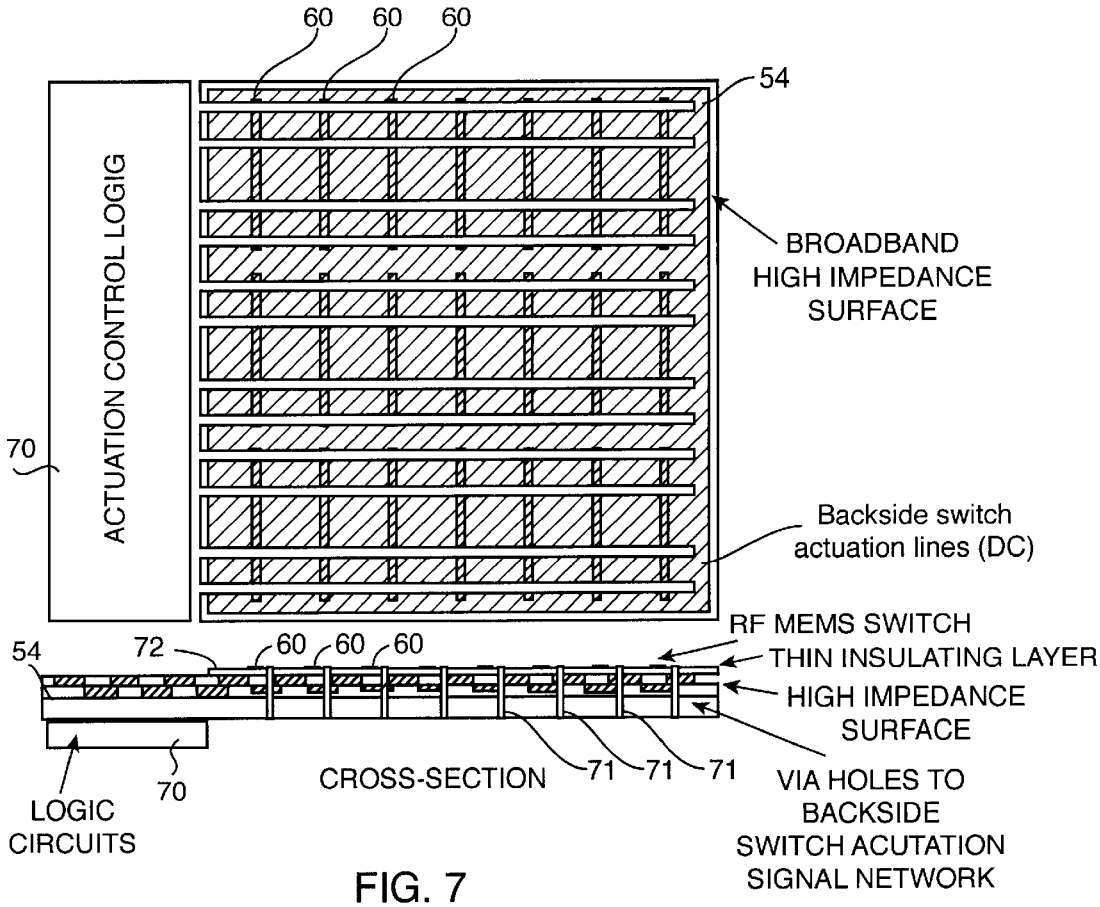
FIG. 7 depicts an embodiment of the invention where dipole elements as shown in FIG. 6 are fabricated on a high impedance surface, and whose lengths are controlled by an actuation logic circuit.

In accordance with this invention, and referring to FIG. 7, a reconfigurable array of dipole elements 60 is fabricated above a multiple band, high impedance surface 54, so that the array can be tuned to be resonant at different frequencies, and a beam can be steered at those frequencies. Assuming a high impedance surface that reflects with little phase shift over an octave or more in bandwidth, the dipole lengths can be changed in large increments to change the array operating frequency band. For example, reducing the length of a dipole by half, will move its resonant frequency up an octave, from f to 2f. This concept is illustrated by FIG. 6. For ease of understanding, let us assume that RF MEMS switches 67 are all closed, thereby conductively connecting dipole segment 62 to dipole segments 65 and 61 on one side and to dipole segments 65 and 63 on the other side. Let us further assume that RF MEMS switches 66 are open. In this configuration the length L of the dipole element 60 is equal to the sum of the lengths of segments 61, 62, 63, 65, and RF MEMS switches 67. Finally, let us call f the resonant frequency of this dipole element 60 of length L. In this configuration the user can:

(1) Steer the beam by closing selected ones of RF MEMS switches 66, thereby increasing the length of the dipole 60 by small amounts. In the particular example of FIG. 6, six small segments 64 can be added to the dipole main body, three on each side. These small changes in length have the effect of modifying the dipole resonant frequency, thereby changing its reflection phase. When such dipoles are disposed in an array, they can be tuned to create a reflection phase gradient across the array, allowing for steering of the reflected beam.

(2) Reconfigure the operating frequency by opening RF MEMS switch 68 (the particular switch of group 67 that is connected to segment 61) and 69 (the particular switch of group 67 that is connected to segment 63), thereby conductively disconnecting segments 61 and 63 from center segment 62, and reducing the length of the dipole 60 from L to L/2. This has the effect of moving the dipole resonant frequency up an octave, from f to 2f, thereby reconfiguring the dipole operating frequency. In a manner analogous to (1), beam steering can be performed at this new operating frequency, by actuating RF MEMS switches 67, and changing the length of dipole 60 by small amounts.

Numerous other embodiments than the one shown in FIG. 6 can easily be imagined. For example the dipole could be finely segmented along its entire length, with RF MEMS switches interconnecting the segments, thus achieving a high degree of functionality and a multitude of frequency bands. An array of such dipoles can be fabricated on a single substrate tile, with larger antennas requiring multiple tiles.

Referring to FIG. 7, an array of RF MEMS switched dipoles 60 is fabricated on top of a thin insulating layer 72, and disposed on a multiple band high impedance surface 54. As previously explained, the operational frequency band of the array is set by switching in or out the larger metallic segments of each dipole. Switching in or out the smaller metallic segments allows to steer the reflected beam in two angular directions. A switch actuation logic control circuit 70 is preferably placed behind the high impedance surface 54, so as to isolate it from the potentially disturbing radiating dipoles. Each switch comprises two DC lines to apply the actuation voltage, and since the lines carry solely DC voltage, they can be placed very close together in a very dense actuation network disposed behind the high impedance surface 54. Furthermore, the cantilever beam that opens and closes the switch has a DC actuation electrode that is set apart from the RF electrode, thereby completely isolating the DC pads from the RF pads within the switch. Thus, without seriously affecting the dipoles, very tiny feed-through via holes 71, can be made to bring the actuation voltage through the high impedance surface 54, from the backside network. The switch actuation lines originate from the logic control circuit 70, which allows a desired mode of operation to be selected by actuating the required switches.

Figure 8:
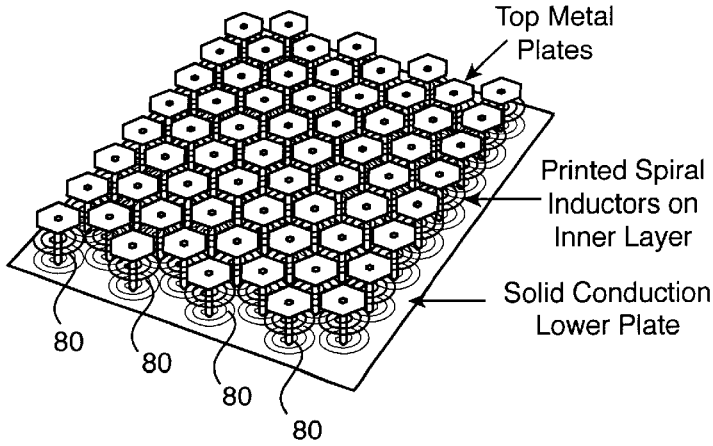
FIG. 8 is a perspective view of a high impedance surface illustrating a method of broadening the surface bandwidth by inserting a layer of spiral inductors.
Figure 9:
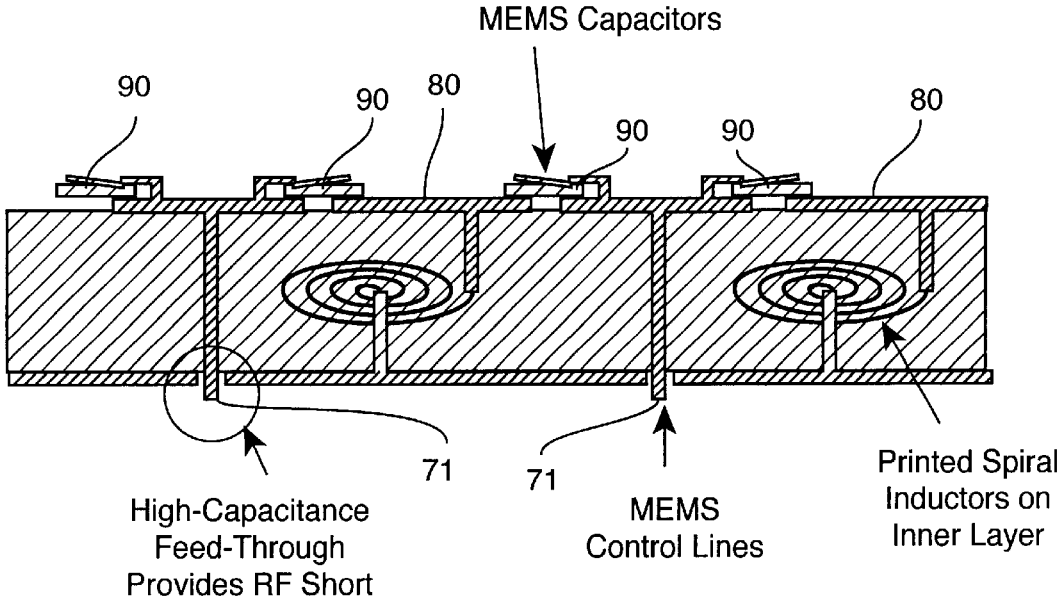
FIG. 9 is a cross-section view of the an embodiment of the invention showing spiral inductors in the middle layer and MEMS switches on the top.

The high impedance surface bandwidth must be made broad enough to allow the array to operate over the desired frequencies. When this is achieved, the high impedance surface effectively behaves like an open circuit. Thus, when the dipoles are located just a fraction of a wavelength away from this surface, the tuning range of the dipoles can be maintained over their full phase range for the bandwidth of the surface. It can be noted from equation 1, that the surface bandwidth can be broadened by increasing the equivalent inductance of the surface. FIG. 8 illustrates a technique for increasing the surface equivalent inductance. A three layer circuit board is used, with the middle layer consisting of printed circuit spiral inductors 80. The inductances and patch sizes are set to the desired center frequency and bandwidth, and maintain a 0° phase change at reflection. FIG. 9 is a view of the circuit board in cross-section. The spiral inductors 80 are printed in the middle layer, while the patches 50 are printed on the top layer. The dipoles are disposed on top the high impedance surface and the MEMS switches 90 are shown in cross-section. The control lines for the MEMS switches are run through the via holes 71.

Other methods of increasing the bandwidth of the high impedance surface include decreasing the surface equivalent capacitance, or using complicated resonant structures that have additional frequencies where the reflected phase goes to 0°.

Having described the invention in conjunction with certain embodiments thereof, modifications and variations will now certainly suggest themselves to those skilled in the art. As such, the invention is not limited to the disclosed embodiments except as required by the appended claims.

We claim:

1. A method of reconfiguring an antenna array for operating at multiple frequency bands, comprising the steps of:

(a) providing a high impedance surface;

(b) disposing an array of dipole elements on said surface; and (c) adjusting the lengths of selected ones of said dipole elements in said array, whereby to change the resonant frequency of said selected ones of said dipole elements.

2. The method of claim 1 wherein the high impedance surface is a multiple band high impedance surface.

3. The method of claim 1 wherein the step of adjusting the length of selected ones of said dipole elements, comprises:

(a) segmenting said dipole elements into a plurality of segments, each segment being coupled to or decoupled from an adjacent segment by a switch; and (b) actuating said switches to thereby vary the lengths of selected ones of said dipole elements.

4. The method of claim 3 wherein the high impedance surface is a multiple band impedance surface.

5. The method of claim 3 wherein the switches are MEMS switches.

6. The method of claim 5 wherein the high impedance surface is a multiple band high impedance surface.

7. A method of steering a radio frequency wave, reflected by an antenna array, the method comprising:

(a) providing a high impedance surface;

(b) disposing an array of dipole elements on said surface; and (c) adjusting the lengths of selected ones of said dipole elements in said array, whereby to change the resonant frequency of said selected ones of said dipole elements.

8. The method of claim 7 wherein the high impedance surface is a multiple band high impedance surface.

9. The method of claim 7 wherein adjusting the length of selected ones of said dipole elements, comprises:

(a) segmenting said dipole elements into a plurality of segments, each segment being coupled to or decoupled from the next segment by a switch; and (b) actuating said switches to thereby vary the lengths of selected ones of said dipole elements.

10. The method of claim 9 wherein the high impedance surface is a multiple band high impedance surface.

11. The method of claim 9 wherein the switches are MEMS switches.

12. The method of claim 11 wherein the high impedance surface is a multiple band high impedance surface.

13. A method of forming a beam in the far-field, comprising the steps of:

(a) providing a high impedance surface;

(b) disposing an array of dipole elements on said surface; and (c) adjusting the lengths of selected ones of said dipole elements in said array, whereby to change the resonant frequency of said selected ones of said dipole elements.

14. The method of claim 13 wherein the high impedance surface is a multiple band high impedance surface.

15. The method of claim 13 wherein adjusting the length of selected ones of said dipole elements, comprises the steps of:

(a) segmenting said dipole elements into a plurality of segments, each segment being coupled to or decoupled from the next segment by a switch; and (b) actuating said switches to thereby vary the lengths of selected ones of said dipole elements.

16. The method of claim 15 wherein the high impedance surface is a multiple band high impedance surface.

17. The method of claim 15 wherein the switches are MEMS switches.

18. The method of claim 17 wherein the high impedance surface is a multiple band high impedance surface.

19. A method of broadening the operating frequency band of a high impedance surface, which comprises:

(a) arranging a plurality of generally spaced-apart conductive surfaces in an array disposed essentially parallel to and spaced from a conductive back plane; and (b) increasing the inductance of said high impedance surface.

20. The method of claim 19 wherein said plurality of generally spaced-apart conductive surfaces are arranged on a printed circuit board.

21. The method of claim 19 wherein the step of increasing the equivalent inductance of said high impedance surface includes disposing a plurality of spiral inductors between at least one of said conductive surfaces and said conductive back plane.

22. The method of claim 19 wherein the size of each conductive surface along a major axis thereof is less than a wavelength of the radio frequency signal, and preferably less than one tenth of the wavelength of the radio frequency signal, and the spacing of each conductive surface from the back plane being less than a wavelength of the radio frequency.

23. The method of claim 19 wherein the radio frequency signal is reflected with a reflection phase of 0°.

24. The method of claim 19 wherein the conductive surfaces are generally planar and wherein the array is generally planar.

25. The method of claim 19 wherein the conductive surfaces are metallic and wherein the conductive back plane is metallic.

26. A reconfigurable antenna array for reflecting a radio frequency beam, comprising:

(a) a high impedance surface;

(b) an insulating layer disposed on said high impedance surface;

(c) a plurality of dipole elements having a resonant frequency and disposed in an array on said insulating layer surface, the resonant frequency of said dipole elements being tunable;

(d) a control device for tuning the resonant frequency of said plurality of dipole elements; and (e) a plurality of connectors coupling said plurality of dipole elements to said control device, thereby allowing the tuning of the resonant frequency of each dipole element.

27. The reconfigurable antenna array of claim 26, wherein each element of said plurality of dipole elements comprises:

(a) a plurality of dipole segments;

(b) a plurality of switches for coupling/decoupling selected ones of said dipole segments, to thereby change the length of the corresponding dipole element, thereby changing its resonant frequency; said plurality of switches being actuated by said control device.

28. The reconfigurable antenna array of claim 27, wherein said switches are MEMS switches.

29. The reconfigurable antenna array of claim 26, wherein the high impedance surface is a multiple band high impedance surface.

30. The reconfigurable antenna array of claim 26, wherein the control device comprises logic circuits.

31. The reconfigurable antenna array of claim 26 configured to operate at multiple frequency bands.

32. The reconfigurable antenna array of claim 26 configured to steer the reflected radio beam into a selected direction.

33. The reconfigurable antenna array of claim 26 configured to form a antenna beam in the far-field.

34. A high impedance surface for reflecting a radio frequency beam, the surface comprising:

(a) a ground plane;

(b) a plurality of elements disposed in an array a distance from the ground plane, the distance being less than a wavelength of the radio frequency beam; and (b) an inductor arrangement for increasing the surface inductance, thereby broadening the operating bandwidth of said surface.

35. The high impedance surface of claim 34 further including a substrate having first and second major surfaces, said substrate supporting said ground plane on the first major surface thereof and supporting said plurality of elements on the second major surface thereof.

36. The high impedance surface of claim 34 wherein the plurality of elements is arranged in a planar array.

37. The high impedance surface of claim 34, wherein said inductor arrangement comprises spiral inductors.

38. A method of reconfiguring an antenna array for operating at multiple frequency bands, comprising the steps of:

(a) providing a high impedance surface;

(b) applying an insulating layer to a side of the high impedance surface;

(c) disposing an array of switched dipole elements on said insulating layer, each switched dipole element comprising a plurality of metallic segments and one or more switching elements coupling adjacent metallic segments of the plurality of metallic segments; and (d) adjusting the lengths of selected ones of said switched dipole elements by actuating selected switching elements.

39. The method according to claim 38, wherein the said antenna array has a minimum operating wavelength and said insulating layer has a thickness less than one-quarter of the minimum operating wavelength.

40. A method of broadening the operating frequency band of a high impedance surface, comprising the steps of:

(a) providing a high impedance surface comprising a plurality of generally spaced-apart conductive surfaces in an array disposed essentially parallel to and spaced apart from a conductive back plane; and (b) coupling at least one conductive surface of the plurality of generally spaced-apart conductive surfaces to the conductive back plane with one or more printed circuit spiral inductors.

41. The method of claim 40, wherein the high impedance surface comprises a three layer printed circuit board having an upper layer, a middle layer, and a lower layer, the upper layer comprising the plurality of generally spaced-apart conductive surfaces, the middle layer comprising the one or more printed circuit spiral inductors, and the lower layer comprising the conductive back plane.

42. A high impedance surface for reflecting a radio frequency beam, the surface comprising:

(a) a ground plane;

(b) a plurality of spaced-apart conductive elements disposed in an array, the plurality of spaced-apart conductive elements being disposed generally parallel to the ground plane and being spaced from the ground plane by a distance less than a wavelength of the radio frequency beam; and (c) one or more printed circuit spiral inductors coupling at least one conductive element to the ground plane.

43. The high impedance surface of claim 42, wherein the high impedance surface comprises a three layer printed circuit board having an upper layer, a middle layer, and a lower layer, the upper layer comprising the plurality of spaced-apart conductive elements, the middle layer comprising the one or more printed circuit spiral inductors, and the lower layer comprising the ground plane.

* * * * *